US011117771B2

(12) United States Patent
Hada et al.

(10) Patent No.: US 11,117,771 B2
(45) Date of Patent: Sep. 14, 2021

(54) WEB TENSION CONTROL

(71) Applicant: Kimberly-Clark Worldwide, Inc., Neenah, WI (US)

(72) Inventors: Frank S. Hada, Appleton, WI (US); Mark G. Dollevoet, Appleton, WI (US)

( * ) Notice: Subject to any disclaimer, the term of this patent is extended or adjusted under 35 U.S.C. 154(b) by 0 days.

(21) Appl. No.: 16/970,472

(22) PCT Filed: Jan. 31, 2020

(86) PCT No.: PCT/US2020/016213
§ 371 (c)(1),
(2) Date: Aug. 17, 2020

(87) PCT Pub. No.: WO2020/160473
PCT Pub. Date: Aug. 6, 2020

(65) Prior Publication Data

US 2021/0087011 A1 Mar. 25, 2021

Related U.S. Application Data

(60) Provisional application No. 62/799,674, filed on Jan. 31, 2019.

(51) Int. Cl.
*B65H 23/26* (2006.01)
*B65H 23/06* (2006.01)
(Continued)

(52) U.S. Cl.
CPC ..... *B65H 23/063* (2013.01); *B65H 23/044* (2013.01); *B65H 23/085* (2013.01); *B65H 23/26* (2013.01); *B65H 2553/20* (2013.01)

(58) Field of Classification Search
CPC .... B65H 23/185; B65H 23/26; B65H 23/044; B65H 23/085
See application file for complete search history.

(56) References Cited

U.S. PATENT DOCUMENTS 3,659,767 A 5/1972 Martin
3,912,188 A * 10/1975 Ballard ..... B65H 23/26 242/547

(Continued)

FOREIGN PATENT DOCUMENTS

CN 102556737 A 7/2012
CN 108439004 A 8/2018

OTHER PUBLICATIONS

Whiteside, Darrel, "Understanding Dancer Tension Control Systems", TAPPI, http://www.tappi.org/content/events/10PLACE/papers/whiteside.pdf.

(Continued)

*Primary Examiner* — Sang K Kim
(74) *Attorney, Agent, or Firm* — Kimberly-Clark Worldwide, Inc.

(57) ABSTRACT

The current invention is generally directed to apparatuses and methods for controlling tension and tension disturbances in a web being continuously unwound from a roll of spirally wound web material. In accordance with the present disclosure, a rotary dancer mechanism is used for applying active and variable forces to a moving web in response to irregularities, such as variations in tension. In one aspect, the apparatus and method of the present disclosure may be used to attenuate undesired disturbances in the web as the web is being fed into a process.

4 Claims, 7 Drawing Sheets

(51) Int. Cl.
*B65H 23/04* (2006.01)
*B65H 23/08* (2006.01)

(56) References Cited

U.S. PATENT DOCUMENTS

| | | | | | |
|---|---|---|---|---|---|
| 4,000,865 | A | * | 1/1977 | Gaskins | B65H 23/063 242/421.6 |
| 4,129,238 | A | * | 12/1978 | Herd | B41F 13/025 101/181 |
| 4,151,594 | A | | 4/1979 | Stern | |
| 5,659,229 | A | | 8/1997 | Rajala | |
| 6,473,669 | B2 | | 10/2002 | Rajala et al. | |
| 6,845,282 | B2 | | 1/2005 | Franz | |
| 6,991,144 | B2 | | 1/2006 | Franz et al. | |
| 7,092,781 | B2 | | 8/2006 | Franz et al. | |
| 8,413,920 | B2 | | 4/2013 | Solberg et al. | |
| 9,309,081 | B2 | | 4/2016 | Duehring et al. | |
| 2004/0256435 | A1 | | 12/2004 | St. Germain | |
| 2011/0246127 | A1 | | 10/2011 | Schnabel et al. | |
| 2015/0021425 | A1 | | 1/2015 | Yamaguchi et al. | |
| 2015/0048198 | A1 | | 2/2015 | DeBruler et al. | |
| 2015/0102152 | A1 | | 4/2015 | Duehring et al. | |

OTHER PUBLICATIONS

Machine Design, "Controlling web tension with load cells", http://www.machinedesign.com/archive/controlling-web-tension-load-cells-part-1-3.

* cited by examiner

WEB TENSION CONTROL

TECHNICAL FIELD

The current invention relates to apparatuses and methods for controlling tension in a sheet of web material being unwound from a roll of material. More specifically, the current invention relates to a rotary dancer mechanism that may be used to control unwinding of roll material and more particularly an out-of-round roll with improved speed and consistent tension.

BACKGROUND OF THE DISCLOSURE

Winders and rewinders are machines that roll lengths of web material, such as paper and nonwoven materials or any other material that may be spirally about a core to form a roll. A winder is typically known as an apparatus that performs the very first wind of a web, forming what is generally known as a parent roll. A rewinder, on the other hand, is typically known as an apparatus that unwinds the parent roll into smaller rolls that represent the finished product. For instance a parent roll of bath tissue may be unwound in a continuous fashion by a rewinder and fed into a process by which the tissue is wound onto cores supported on mandrels to provide individual, relatively small diameter logs of material. The rolled product log material may then be cut to designated lengths into the finalized product. In addition to toilet tissue rolls, other finalized products that may be made by this process include paper towels, paper rolls, nonwoven materials or any other material that may form a parent roll.

Typically, the parent rolls are moved to storage locations until they are consumed in a converting process during which the finalized products are made. The handling and storage of the parent rolls may subject the rolls to certain stresses that cause the rolls to become disoriented from a pure cylindrical shape. Storing a parent on a hard surface, for instance, may cause a flat spot on the roll. Such rolls can have an elliptical or eccentric shape, often referred to as an out-of-round roll (OOR), depending upon how the roll is handled.

As the rolls are unwound by a rewinder, any out-of-roundness characteristics may cause tension disturbances within the web. These tension disturbances may cause many problems. Differences in tension in the web as the web is fed into a process may cause machine malfunctions, web breaks, and can lead to the production of non-uniform finalized products.

In the past, in order to control tension fluctuations, dancer rolls were inserted into the process between first and second sets of driving rolls or between first and second nips. The basic purpose of a dancer roll is to maintain constant tension on the continuous web (or sheet) as the web is fed into a downstream process and traverses a span between first and second sets of driving rolls.

As the web traverses the span, passing over the dancer roll, the dancer roll moves up and down in a track, serving two functions related to stabilizing the tension in the web. First, the dancer roll provides a damping effect on intermediate term disturbances in the tension in the web. Second, the dancer roll temporarily absorbs the difference in drive speeds between the first and second sets of driving rolls, until such time as the drive speeds can be appropriately coordinated.

Usually the dancer roll is suspended on a support system, wherein a generally static force supplied by the support system supports the dancer roll against an opposing force applied by the tension in the web and the weight of the dancer roll. So long as the tension in the web is constant, the dancer roll remains generally centered in its operating window on the track.

When the web encounters an intermediate or long term tension disturbance, temporarily increasing or decreasing the tension in the web, the imbalances of forces on the dancer roll cause translational movement in the dancer roll to temporarily restore the tension, and thereby the force balance. So when difference in the speeds of the first and second sets of drive rolls tend to accord a change in the web tension, the dancer roll temporarily maintains the tension. While the dancer roll, as conventionally used, provides valuable functions, it also has its limitations. Examples of dancer rolls are described in U.S. Pat. No. 5,659,229, U.S. Publication 2015/0102152 and in U.S. Pat. No. 6,856,850, which are all incorporated herein by reference.

Further improvements are still needed, however, for an apparatus for controlling a web tension that has fast and variable response times, especially when the web is moving at high speeds.

SUMMARY OF THE INVENTION

The current invention is generally directed to apparatuses and methods for controlling tension and tension disturbances in a web being continuously unwound from a parent roll, and more particularly, an out-of-round (OOR) roll of spirally wound web material. In accordance with the present invention, a rotary dancer mechanism is used for applying active and variable forces to a moving web in response to irregularities, such as variations in tension. The web tension control apparatuses and methods of the current invention are an improvement over conventional active and passive dancer rolls, which are generally limited in their ability to control downstream web tension while in motion. Unlike conventional active and passive dancer rolls, which generally experience large forces due to gravity and static friction that limit their ability to attenuate tension disturbances, the rotary dancer of the current invention experiences limited gravitational forces and only limited bearing friction when in use. Additionally, the apparatus of the current invention is a fairly simple design with few moving parts, which is in contrast to conventional active and passive dancer rolls that have a complex set of cable and pulley assemblies.

Accordingly, in one embodiment, the current invention provides an apparatus for unwinding a web comprising a roll of spirally wound web material; a first motor for rotating the roll of spirally wound web material; a rotary dancer mechanism for controlling the tension of web material unwound from the roll of spirally wound web material comprising a rotatable arm having a longitudinal axis and first and second ends, a non-driven roller disposed on rotatable arm and movable along the longitudinal axis, a counterweight disposed on the rotatable arm opposite of the non-driven roller and movable along the longitudinal axis; and a second motor attached to the rotatable arm and configured to supply a controllable amount of torque to the arm. The apparatus of the current invention may be used to attenuate undesired disturbances in the web as the web is being fed into a process.

In a further embodiment of the current invention, the invention includes a method for controlling tension in a web being unwound from an OOR roll of spirally wound web material where the OOR roll has a high and a low point. The method includes measuring major and minor lobes of the OOR roll. The method also includes determining the mean diameter of the OOR roll. The method further includes determining the distance between the OOR roll and a rotary dancer mechanism. The rotary dancer mechanism includes a non-driven roller that is positioned on a rotatable arm that has a longitudinal axis. The rotatable arm is attached to a motor configured to apply a controlled amount of torque to the rotatable arm and rotate the rotatable arm 360°. The method also includes unwinding the web material from the OOR and feeding the unwound web material over the non-driven roller positioned on the rotatable arm and rotating the arm 360°. The method further includes repeating the aforementioned steps to determine an offset magnitude. Thereafter, the method includes moving the non-driven roller along the longitudinal axis of the rotatable arm based on the determined offset magnitude.

In another embodiment of the current invention, a method for controlling tension in a web being fed to a process is disclosed. The method includes unwinding a roll of spirally wound web material. Additionally, the method includes feeding the unwound web material over a non-driven roller disposed on a rotatable arm having a longitudinal axis. The method further includes attaching the rotatable arm to a motor configured to apply a controlled amount of torque to the arm and rotating the arm 360°. The method also includes sensing the tension of the web after it exits the non-driven roller. The method further includes controlling tension of the web material exiting the non-driven roller by adjusting the position of the non-driven roller along the longitudinal axis of the rotatable arm, by adjusting the amount of torque applied to the rotatable arm by the motor, or a combination of both.

A further embodiment of the current invention is directed to an apparatus for unwinding a roll of spirally wound web material. The apparatus includes a roll of spirally wound web material with a first motor for rotating the roll of spirally wound web material. The apparatus also includes a rotary dancer mechanism for controlling the tension of web material unwound from the roll of spirally wound web material. The rotary dancer mechanism includes a rotatable arm having a longitudinal axis and first and second ends, a non-driven roller positioned on the rotatable arm and movable along the longitudinal axis, a counterweight positioned on the rotatable arm and opposite of the non-driven roller, wherein the counterweight is movable along the longitudinal axis. The apparatus also includes a second motor attached to the rotatable arm and the second motor is configured to supply a controllable amount of torque to the rotatable arm. The apparatus further includes a load cell in communication with the second motor and configured to sense the tension of web material unwound from the roll upon exiting the rotary dancer mechanism.

Many modifications and variations of the present disclosure may be made without departing from the spirit and scope thereof. Therefore, the exemplary embodiments described above should not be used to limit the scope of the invention.

BRIEF DESCRIPTION OF DRAWINGS

The invention may be more completely understood in consideration of the following detailed description of various embodiments in connection with the accompanying drawings, in which.

DETAILED DESCRIPTION OF THE DISCLOSURE

Figure 1:
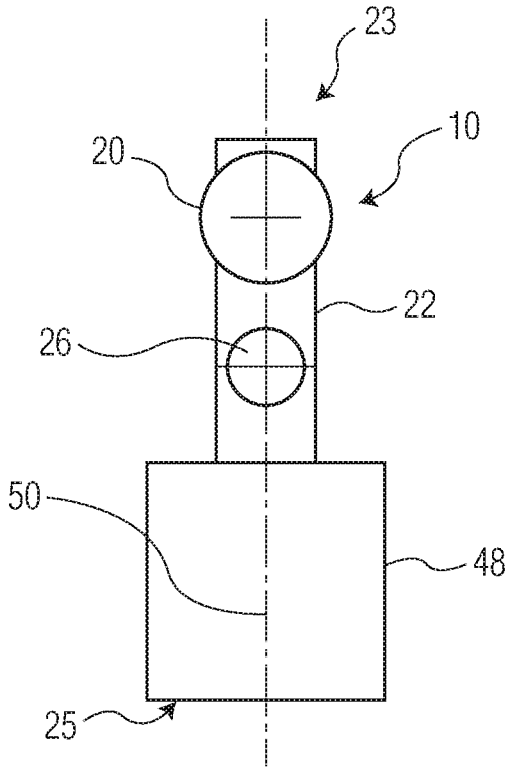
FIG. 1 is a side view of a rotating dancer mechanism in accordance with the present disclosure.
Figure 2A:
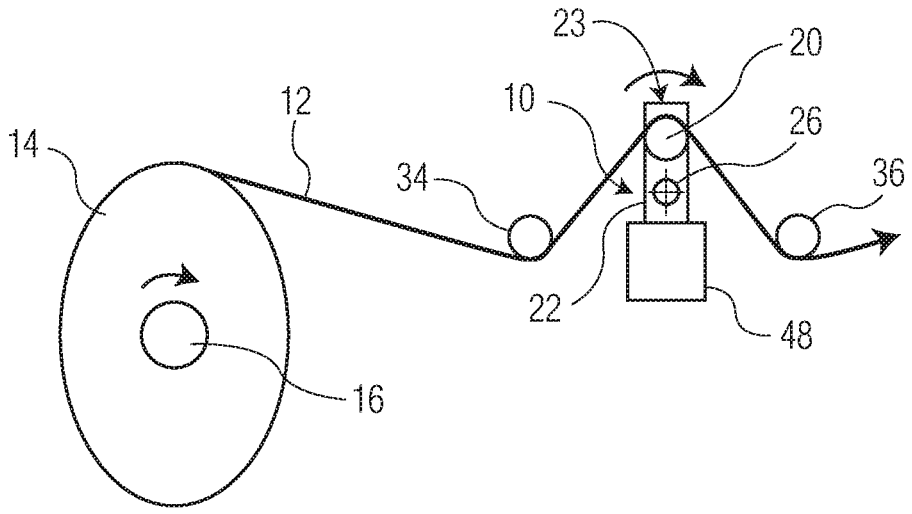
FIGS. 2A-2D are side views of a rotating dancer mechanism in accordance with the present disclosure showing different rotational positions of the apparatus.
Figure 2B:
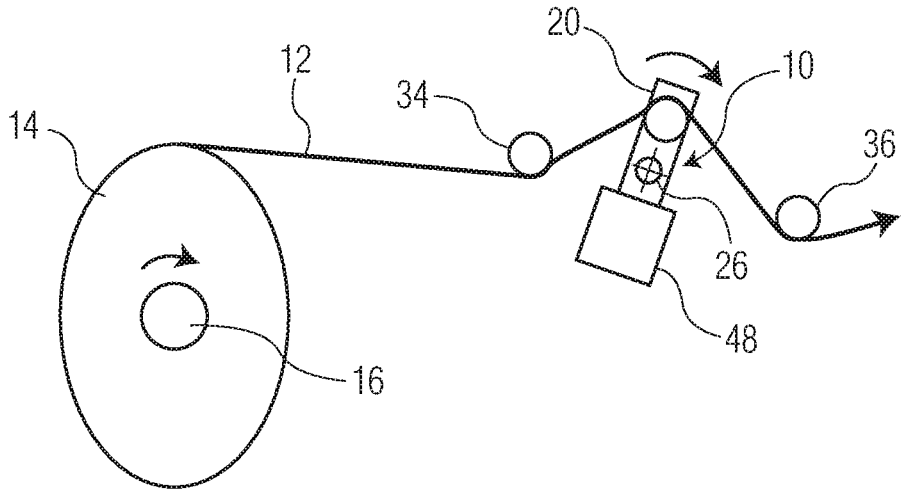
Figure 2C:
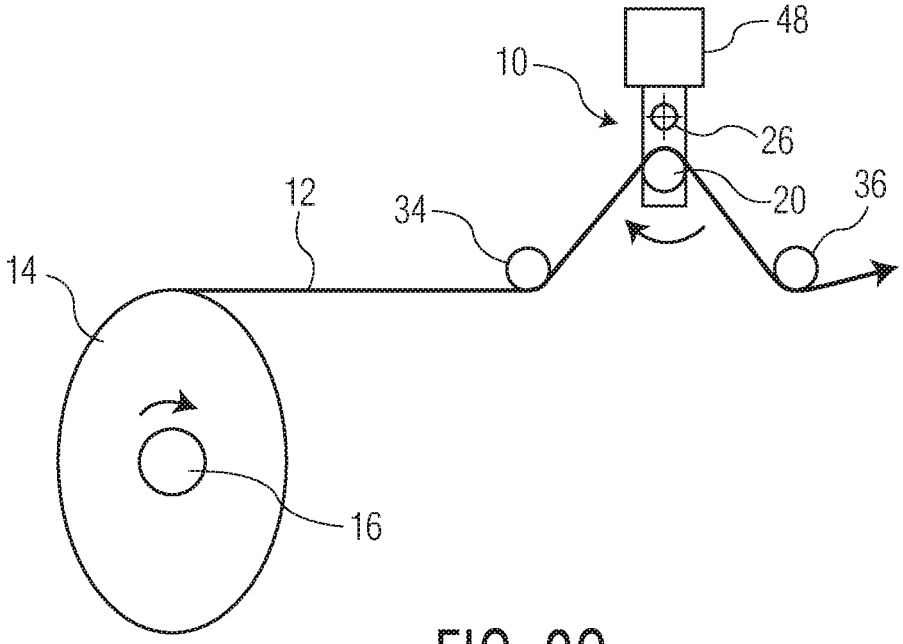
Figure 2D:
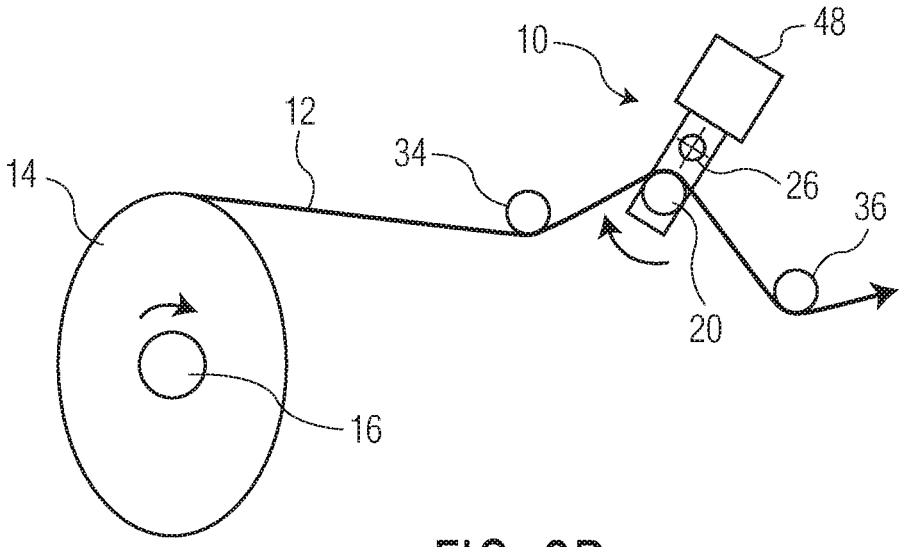

When introducing elements of the current invention or the preferred embodiment(s) thereof, the articles "a", "an", and "the" are intended to mean that there are one or more of the elements.

The terms "comprising", "including" and "having" are intended to be inclusive and mean that there may be additional elements other than the listed elements.

In the past, manufacturers of web materials have carefully controlled the manner in which the web materials were produced and have carefully controlled the conditions under which the out-of-round (OOR) rolls were stored in order to avoid the necessity of having to process OOR rolls. For example, manufacturers of paper, nonwoven or similar webs thereof typically use great amounts of energy to make sure that the web is completely dried before the web is wound onto a core to prevent the wound roll from becoming OOR. A drier web material will generally produce less OOR rolls and provides for a better material for use in converting processes. Consequently, paper or nonwoven webs are typically dried so that the moisture content in the web is no greater than about 2% by weight. Requiring the webs to be dried to such extreme amounts, however, slows processing speeds significantly and may greatly increase the cost of producing the product.

In addition to thoroughly drying the webs, manufacturers also carefully handle and store the rolls prior to being used in a converting process in order to prevent OOR rolls. For instance, storing the rolls on a flat surface or stacking the rolls may create flat surfaces which may create problems when the rolls are unwound into a process. In other words, large, high-bulk, through-air dried parent rolls of material are subject to distortion from handling and storage. Large diameter parent rolls are desired because this minimizes the roll change time and improves the efficiency of the converting process. Distortion is particularly evident after the rolls have been stored, where the weight of the roll compresses one side of the roll resulting in rolls having an oval or eccentric shape. These OOR rolls cause tension fluctuations when the roll is unwound by a center driven unwind that can lead to web breaks and variable density logs of material.

To improve the unwinding of OOR rolls, the current invention provides a rotary dancer mechanism for controlling tension and tension disturbances of the web as it is unwound. Unlike prior art dancer devices, the current invention provides a dancer having a rotatable arm and a non-driven roller to support the web as it is unwound. The instant rotary dancer mechanism has extremely fast response times to tension variations. As such, processes incorporating the apparatuses are capable of processing rolls that have a greater degree of eccentricity compared to prior art dancers. The faster response time also enables OOR rolls to be processed at faster speeds in comparison with past apparatuses. Having the capability to process OOR rolls allows manufacturers to produce web materials that contain a greater amount of moisture. Allowing the machines to produce a wetter roll allows for higher processing speeds and greater throughput to make the web. An additional benefit is that the OOR rolls produced may potentially be double stacked in a warehouse prior to converting. By increasing warehouse capacity, less machine grade changes may be needed.

In certain embodiments, the invention provides an improved method of controlling tension variation in a web unwound from an OOR roll using a rotary dancer mechanism having a non-driven roller that is moveable along the longitudinal axis of a rotatable arm. In-use, the rotatable arm has a rotational speed roughly equivalent to two times the rotational speed of the OOR roll and may be phased to the variation in web tension caused by the eccentricity of the OOR roll. In certain instances the arm may rotate continuously as the OOR roll is unwound and this continuous motion may reduce the acceleration required and therefore the load on the system.

Figure 3:
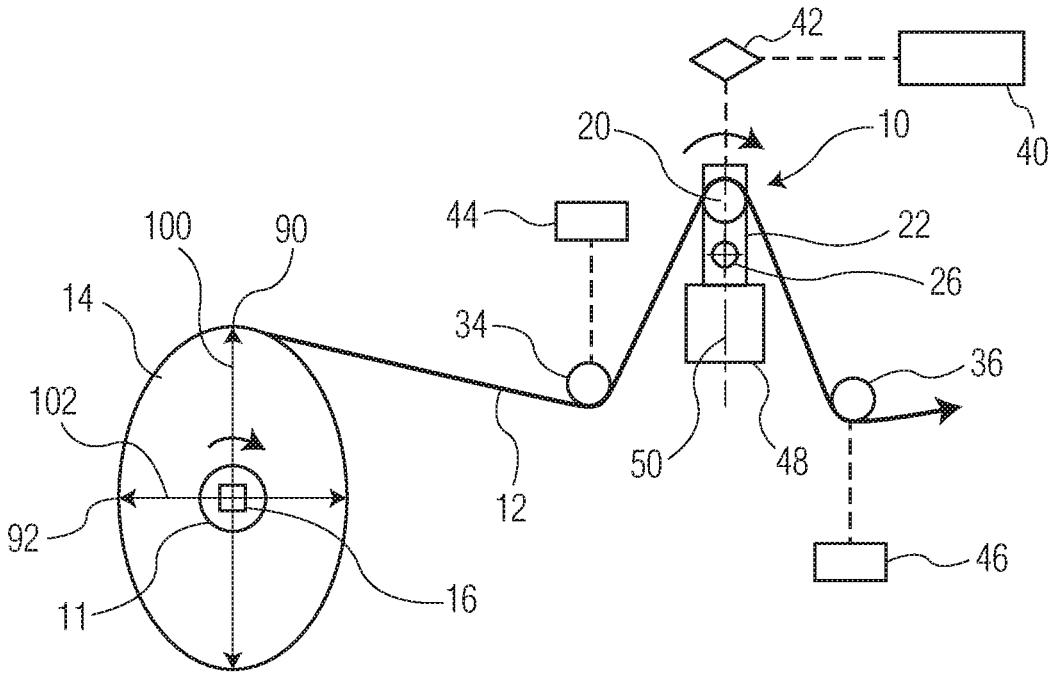
FIG. 3 is a side view of one embodiment of an apparatus made in accordance with the present disclosure for controlling tension in a roll of web material.
Figure 4:
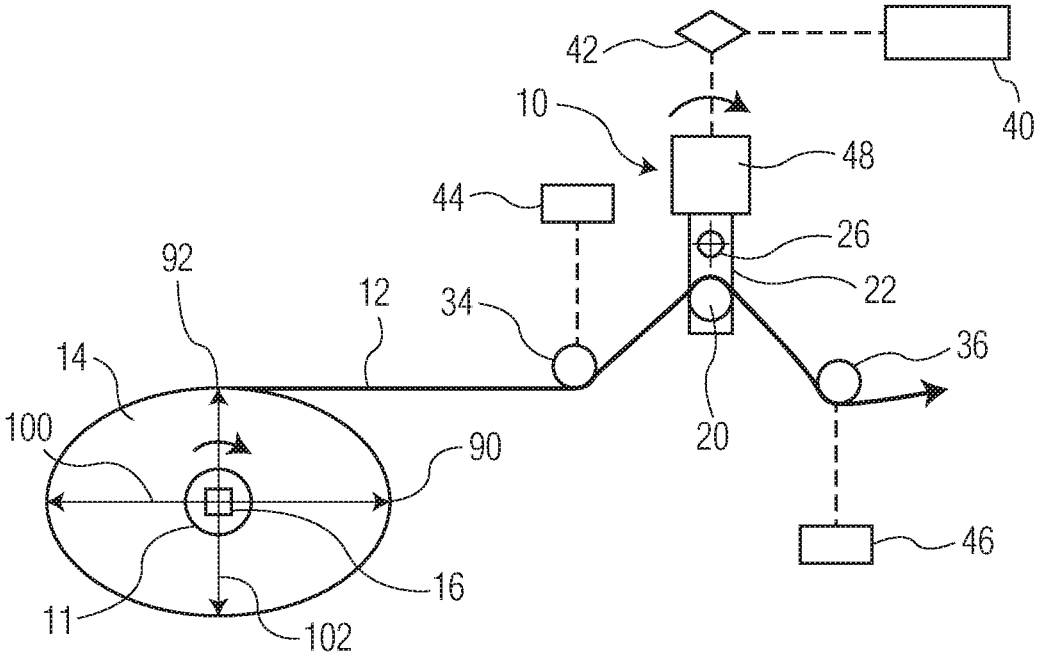
FIG. 4 is a side view of one embodiment of an apparatus made in accordance with the present disclosure for controlling tension in a roll of web material.
Figure 5:
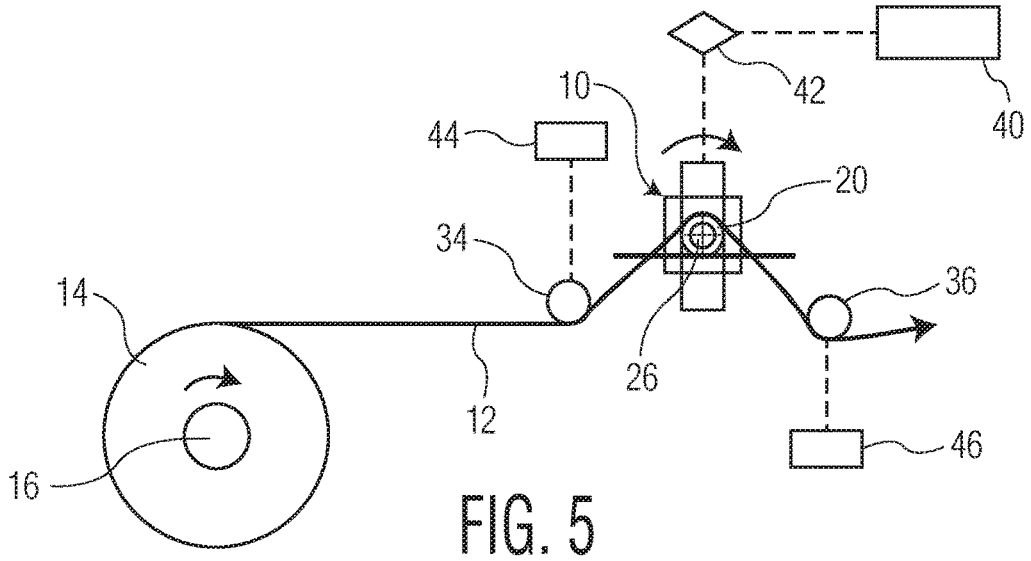
FIG. 5 is a side view of one embodiment of an apparatus made in accordance with the present disclosure for controlling tension in a roll of web material.

With reference now to FIG. 1, one embodiment of a rotary dancer mechanism 10 useful in the present invention is illustrated. Generally, the rotary dancer mechanism is provided downstream of a parent roll to control the tension of a web material being unwound from the roll, such as illustrated in FIGS. 3-5. The rotary dancer mechanism 10 comprises a linkage, referred to herein as a rotatable arm 22, having first and second ends 23, 25 and rotatable about a pivot point 26. At a first end 23 of the rotatable arm 22 is a roller 20, which is preferably light weight, low inertia and non-driven. The non-driven roller 20 is generally configured to support the web material 12 as it is unwound from a roll. A counterweight 48 is disposed opposite the non-driven roller 20 at the second end 25 of the rotatable arm 22.

The arm 22 is rotated by a rotary drive (not illustrated), which may rotate the arm 22 about a rotary pin. As the arm 22 rotates, the rotary dancer mechanism 10 stores a certain length of sheet-material web and/or generates a desired level of tensioning in the sheet-material web supported by the roller non-driven roller 20. As will be readily clear to a person skilled in the art, the length of sheet material stored depends on the angle of rotation of the rotatable arm 22 between 0 and more or less 180°. As already explained, the rotatable arm 22 is driven by means of a motor. This motor may be a servomotor, or actuating motor, or a stepping motor or a pneumatic drive. In the case of the pneumatic drive, the pressure by which the drive is driven is regulated preferably in dependence on the angular position of the rotatable arm 22. Starting from the zero position (cf. FIG. 3), in which the rotary dancer mechanism 10 stores barely a minimal length of web material 12, if any at all, and the rollers 34, 36 are located, in the present case, below the non-driven roller 20. The rotatable arm 22 may be advanced by the motor to a second position (cf. FIG. 4) more or less 180° from the first position. In the second position the angle of the web material 12 passes over the rollers 34, 36 and the non-driven roller 20 decreases relative to the first position. In other words, as the rotary dancer mechanism 10 rotates from the first position to the second position, the rollers 34, 36 move away horizontally from each other and become closer to the non-driven roller 20. During dynamic operation, the position of the rotatable arm 22 may be continuously changed between the first and the second positions in phase with an OOR roll 14 that is being unwound.

In addition to rotating the arm 22 between a first and second position to control the length of web material 12 being taken up by the system, the position of the non-driven roller 20 relative to the pivot point 26 of the rotatable arm 22 may be adjusted. In this manner, the rotary dancer mechanism 10 may comprise an arm 22 having a longitudinal axis 50 and rotatable about a pivot point 26 and a non-driven roller 20 disposed near the first end 23 thereof and movable between the first end 23 and the pivot point 26 along the longitudinal axis 50. In operation, the position of the non-driven roller 20 may be adjusted as the shape of the roll being unwound changes. For example, as discussed in more detail below, during the initial stages of unwinding an OOR roll 14 the non-driven roller 20 may be disposed near the first end 23 of the rotatable arm 22. As the OOR roll 14 is unwound and the difference between the lengths of the major and minor lobes decreases, the non-driven roller 20 may be moved along the longitudinal axis 50 of the rotatable arm 22 towards the pivot point 26.

Referring to FIGS. 2A-2D, web displacement on the rotary dancer mechanism 10 is illustrated as the rotary dancer mechanism 10 rotates. FIGS. 2A-2D shows different positions as the rotary dancer mechanism 10 rotates in a continuous clockwise motion. At the beginning of the unwind process, shown in FIG. 2A, the non-driven roller 20 is positioned adjacent to the first end 23 of the rotatable arm 22. As OOR becomes less severe as the OOR roll 14 is unwound, the offset of the non-driven roller 20 will adjust toward the rotating assembly center. The portion of the non-driven roller 20 relative to the pivot point 26 of the rotatable arm 22, referred to herein as the offset magnitude (D), may be adjusted based on the difference between the major and minor lobe distances. Further, as the OOR roll 14 is unwound and the difference between the major and minor lobe distances changes, the offset magnitude may be adjusted. Eventually, the major and minor lobe distances may be approximately equal and the rotatable arm 22 may stop rotating and the non-driven roller 20 may be fixed in given position.

With reference now to FIG. 3, the OOR roll 14 comprises a web material 12 spirally wound about a core 11. The OOR has major and minor axis 100, 102, also referred to herein as major and minor lobes. A high point of the OOR roll 14 is defined by a major lobe tangency 90 and a low point of the OOR roll 14 is defined by a minor lobe tangency 92. The major and minor lobe tangencies 90, 92 may be measured using any suitable distance measuring devices including, but are not limited to, lasers, ultrasonic devices, conventional measurement devices, combinations thereof, and the lengths of the major and minor lobes 100, 102 may be determined. The lengths of the major and minor lobes 100, 102 may then in-turn be used to calculate the effective diameter of the OOR roll 14 using Equation 1 below, where X is the major lobe length and Y is the minor lobe length.

$$R_{effective}=(X\cdot Y)^{1/2} \qquad \text{Equation 1}$$

While the current invention is particularly well suited for controlling the tension of a web 12 as it is unwound from an OOR roll 14 it may also be useful in unwinding a substantially round roll such that the major and minor lobe lengths are equal and the OOR roll 14 has an aspect ratio approximately equal to 1.

At the start of unwinding an OOR roll 14, a position sensor (not shown) measures the major and minor lobe tangencies 90, 92 and the effective diameter of the roll is determined using Equation 1 shown above. A position sensor 42 senses the position of the rotatable arm 22 and the arm 22 is rotated to lock the rotary dancer mechanism 10 to an unwind position. A phase offset is calculated dividing the length of web between the major lobe tangency 90 and the non-driven roller 20 by the effective radius. The final phasing is a closed loop control based on feedback from a load cell 46 at the discharge of the rotary dancer mechanism 10.

Referring to FIGS. 3-5, one embodiment of a system for controlling the tension of an OOR roll 14 using a rotary dancer mechanism 10 in accordance with the present invention is shown. In FIGS. 3-5, the rotary dancer mechanism 10 is shown as part of a process by which a web material 12 is unwound from the OOR roll 14 and fed downstream. The OOR roll 14 in FIG. 3 is an elliptical shape and as the OOR roll 14 is unwound it becomes substantially circular as depicted in FIG. 4. The rotary dancer mechanism 10 is configured to respond to tension variations in the web material 12 so that the web material 12 is fed downstream at a relatively constant tension.

As shown in FIGS. 3-5, the OOR roll 14 is unwound from a core 11 using an unwind device 16, such as a motor. Speed of advance of the web material 12 is controlled by the unwind device 16. The rotary dancer mechanism 10 includes a non-driven roller 20 disposed on a rotatable arm 22 having a longitudinal axis 50. The rotatable arm 22 is attached to a motor, not shown, configured so that a controlled amount of torque is applied to the arm 22 and rotates the arm 22 360° about a pivot point 26. The non-driven roller 20 preferably has a low inertia and low weight. The low inertia and weight of the non-driven roller 20 minimizes the drive power to turn the rotatable arm 22. In certain embodiments a counterweight 48 may be disposed opposite the non-driven roller 20 so as to balance the rotatable arm 22 as it rotates. The counterweight 48 may be moveable along the longitudinal axis 50. In those embodiments where the rotatable arm 22 is provided with a counterweight 48 and the counterweight is movable, the counterweight 48 is generally moved in a direction opposite that of the non-driven roller 20 so as to balance the arm 22 as it is rotated.

The rotary dancer mechanism 10 may also be placed in association with a first fixed roll 34 and a second fixed roll 36. The fixed rolls 34 and 36 may facilitate web displacement when the rotary dancer mechanism 10 rotates. The fixed rolls 34 and 36 may be provided with a load sensor and used to facilitate measurements of tension in the web 12. In certain embodiments, such as the embodiments illustrated in FIGS. 3-5, the fixed rolls 34, 36 and non-driven roller 20 are arranged such that the web material 12 assumes a serpentine travel path through the rotary dancer mechanism 10.

Once tension disturbance is experienced, torque may be delivered to the rotatable arm 22 and the speed at which the arm 22 rotates may be varied or controlled such that the rotatable arm 22 rotates 360° continuously and tension of the web material 12 is maintained. For instance, in view of FIGS. 3-5, the position of the rotatable arm 22 may be constantly monitored by a position sensor 42. When the rotatable arm 22 rotates in response to tension variations, the position sensor 42 may send signals to a controller 40 such as a computer. A controller 40 may be used to control the amount of torque applied to the rotary dancer mechanism 10 so as to control the position of the rotatable arm 22. The controller 40 may also be configured to receive information regarding tension and velocity of the rotatable arm 22.

The controller 40 may be in communication with the rotary dancer mechanism 10 and/or the unwind device 16. Based on information received from the position sensor 42, the controller 40 may then send a corrective signal to the unwind device 16 and/or the rotary dancer mechanism 10.

The amount that the web material 12 displaces as the dancer mechanism 10 rotates depends on various dimensions. For example, as the rotary dancer mechanism 10 rotates, the amount of web displacement changes as a function of the rotary position of the dancer mechanism 10 and offset magnitude. For instance, FIG. 6 shows a maximum web displacement for the rotary dancer mechanism 10 wherein the OOR roll 14 is in a major lobe position.

Figure 6:
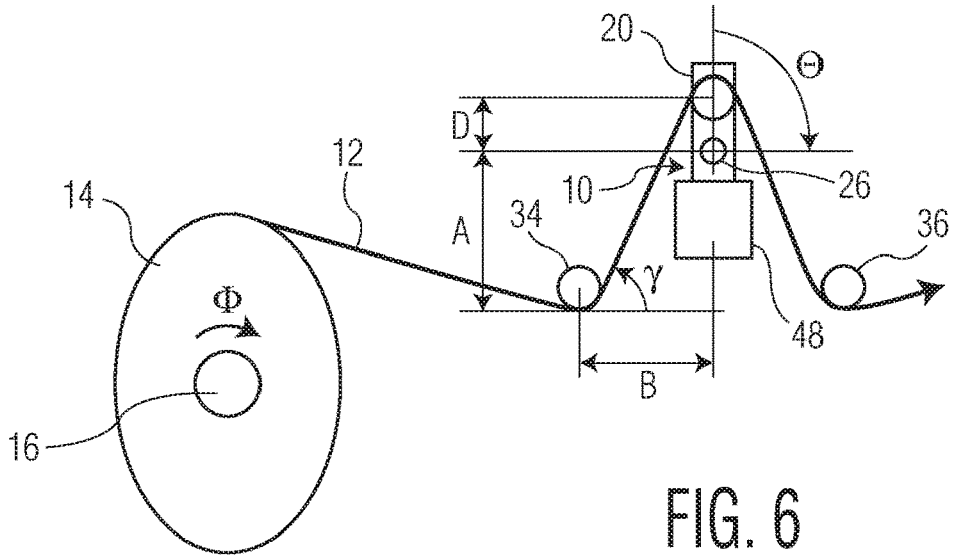
FIG. 6 is a side view of one embodiment of an apparatus in accordance with the present disclosure including variables for calculating web displacement.

When the OOR roll 14 is in the major lobe position as shown in FIG. 6, the web displacement corresponding equation is as follows:

$$L_{max}^2=(A+D)^2+B^2 \qquad \text{Equation 2}$$

wherein $L_{max}$ is the maximum span between the non-driven roller and the rotary dancer mechanism;

A is the fixed vertical distance between the non-driven roller and pivot point of the rotary dancer mechanism;

B is the fixed horizontal distance between the non-driven roller and pivot point of the rotary dancer mechanism;

D is the offset magnitude of the rotating dancer mechanism.

Figure 7:
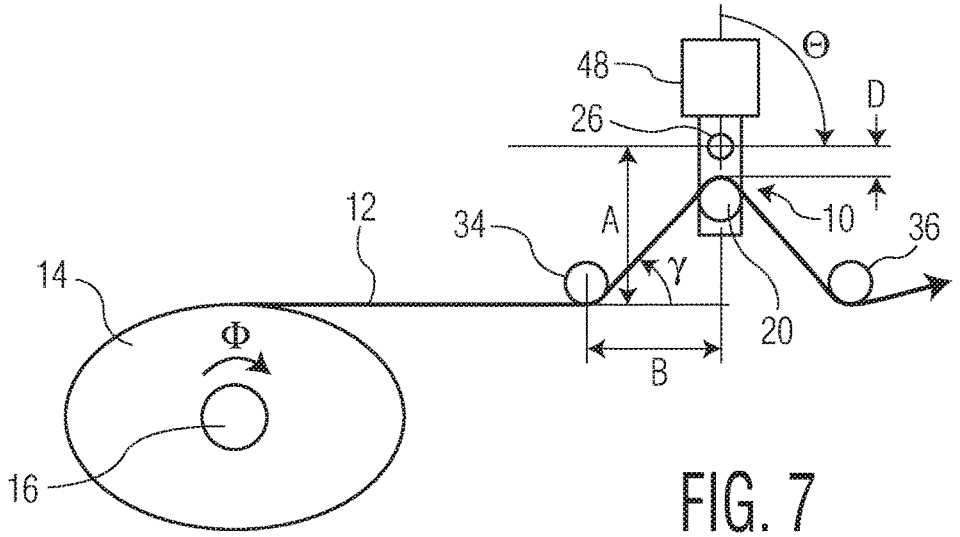
FIG. 7 is a side view of one embodiment of an apparatus in accordance with the present disclosure including variables for calculating web displacement.

FIG. 7 illustrates a minimum web displacement for the rotary dancer mechanism 10 where the OOR roll 14 lies in a minor lobe position. The OOR roll is rotated 90° and the dancer mechanism 10 is rotated 180°.

When the OOR roll 14 is in the minor lobe position as illustrated in FIG. 7, the web displacement corresponding equation is as follows:

$$L_{min}^2=(A-D)^2+B^2 \qquad \text{Equation 3}$$

wherein $L_{min}$ is the minimum span between the non-driven roller and the dancer roller mechanism;

A is the fixed vertical distance between the non-driven roller and pivot point of the rotary dancer mechanism;

B is the fixed horizontal distance between the non-driven roller and pivot point of the rotary dancer mechanism;

D is the offset magnitude of the rotating dancer mechanism.

The web displacement calculations above are an example of one aspect of the current invention.

Figure 8:
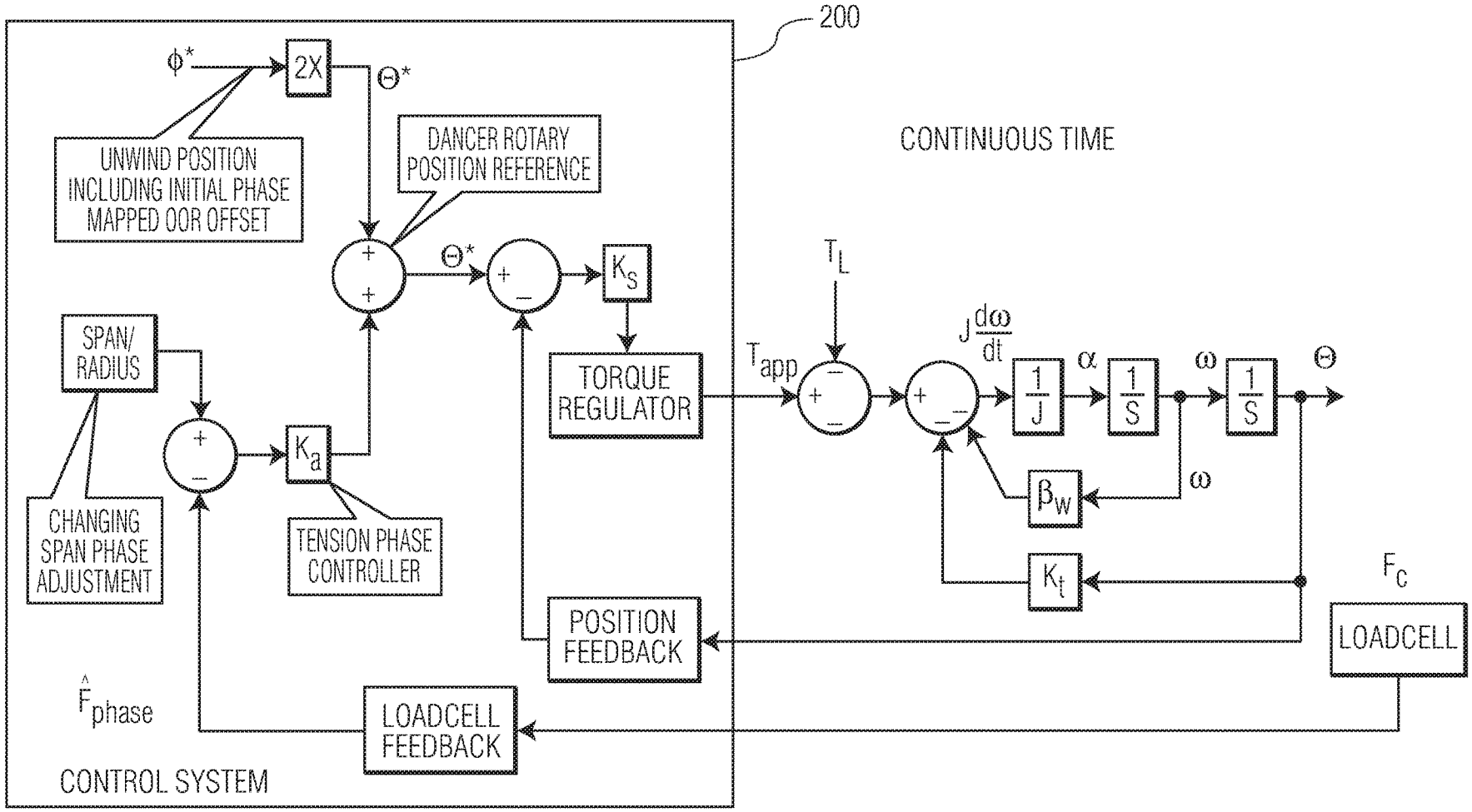
FIG. 8 is one embodiment of a control system block diagram.
Figure 9:
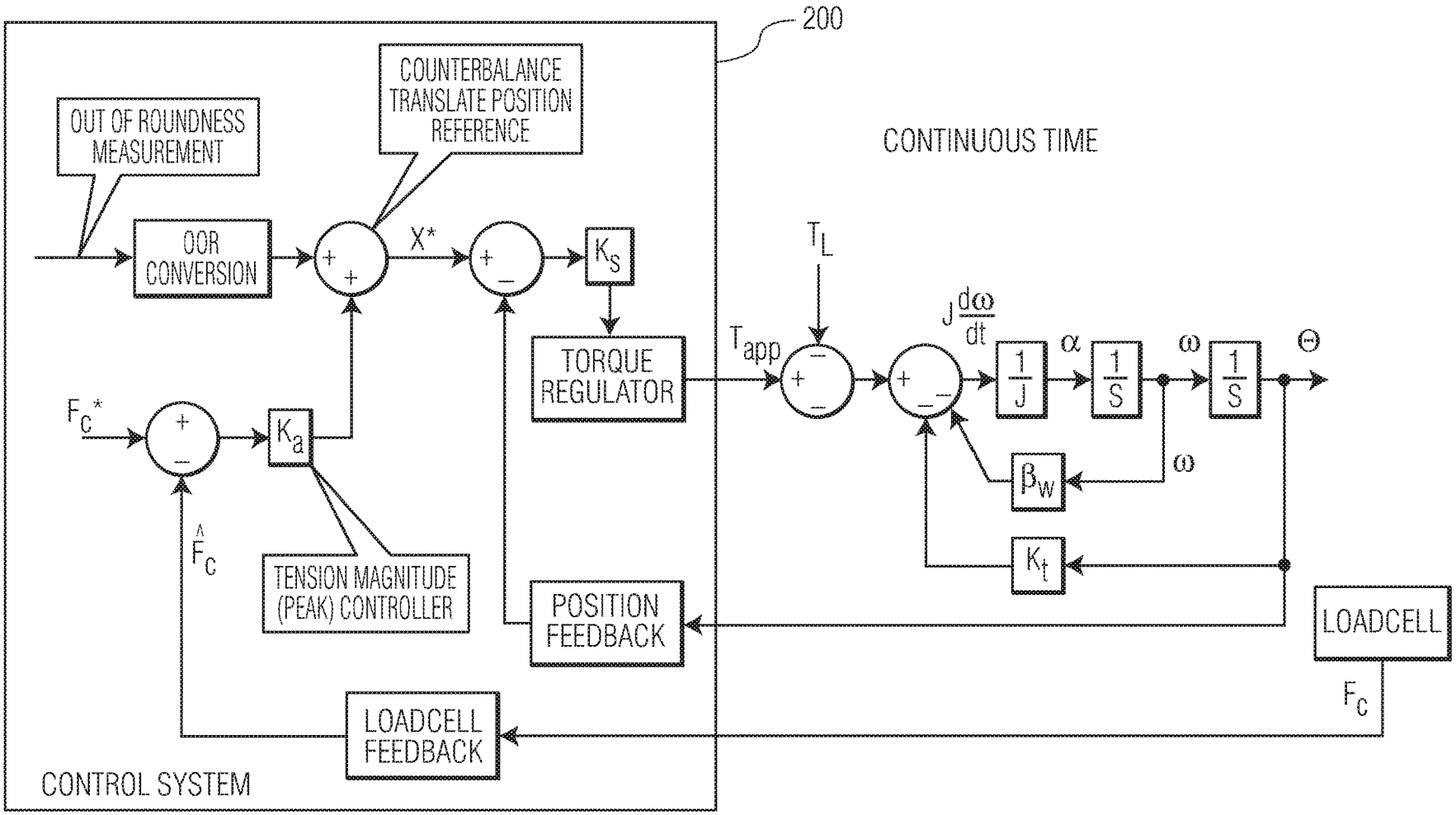
FIG. 9 is another embodiment of a control system block diagram.

A controller 40, such as a programmable device (i.e. a computer) may be configured to receive various information and to calculate an output that controls the offset speed and the amount of torque applied to the pivot location 26 of the rotary dancer mechanism 10. In one embodiment, the controller 40 may be programmed with various algorithms for controlling the different system parameters. For instance, the phasing and magnitude control systems, such as those illustrated in FIGS. 8 and 9, respectively, may be programmed into the controller 40. The variables for equations 4 and 5 are illustrated in FIGS. 8 and 9, respectively. The following equation for the phasing control system shown in FIG. 8 may be derived as:

$$\Theta^*=\phi^*\cdot 2+(\psi^*-F_{phase})\cdot K_{phase} \quad \text{Equation 4}$$

wherein $\phi^*$ is the angular position of the unwind OOR roll;

$\Theta^*$ is the angular position of the rotary dancer mechanism;

$\psi^*$ is the angular offset (phase) of the major lobe of the roll in the unwind OOR roll;

$F_{Phase}$ is the angular offset (phase) of the tension peak relative to an unwind OOR roll angular position;

$K_{phase}$ is the phase controller. $K_{phase}$ may take the form of a proportional plus integral (PI) controller.

The system in FIG. 8 is trimmed to the phase angle of a load cell control loop as shown in FIG. 9.

The following equation for the offset control system shown in FIG. 9 may be derived as:

$$X^*=OOR^*+(F_{mag}{}^*-F_{mag})\cdot K_{mag} \quad \text{Equation 5}$$

wherein

X* is the reference for the offset magnitude;

OOR* is the out of roundness measurement of parent roll expressed in linear units;

$F_{mag}{}^*$ is the reference for the magnitude of tension measurement ripple (non-DC component). $F_{mag}{}^*$ is often zero;

$F_{mag}$ is the measurement of the magnitude of tension measurement ripple (non-DC component);

$K_{mag}$ is the magnitude controller. $K_{mag}$ may take the form of a proportional plus integral (PI) controller.

The distance between the non-driven roller and the pivot point of rotating arm, referred to herein as the offset magnitude (D), may be based on the measurement of the OOR roll. As the roll is unwound and the difference in the major and minor lobe lengths is reduced, the offset magnitude will decrease as the non-driven roller is moved towards the pivot point. The In certain instances, the offset magnitude may be trimmed by the magnitude component of a load cell measuring tension of the web before and/or after the rotary dancer mechanism.

In one embodiment, for the closed loop control system, the apparatus may include a position sensor 42 that senses the position of the rotary dancer mechanism 10. The apparatus may also include a first load cell 44 that measures tension in the web material 12 upstream from the rotary dancer mechanism 10 and a second load cell 46 that measures tension in the web material 12 downstream from the rotary dancer mechanism 10. The position sensor 42, the first load cell 44, and the second load cell 46 may all be configured to send information (i.e. the sensed variable) to the controller 40.

The block diagrams shown in FIGS. 8-9 are directed to controlling the amount of torque applied to the rotary dancer mechanism 10. In order to control tension variations, the controller 40 may also be configured to control the unwind device 16 for controlling the speed at which the web 12 is unwound. FIGS. 8-9 illustrate one embodiment of a block diagram for controlling web acceleration. In this manner, the controller 40 may be configured not only to control the speed or acceleration at which the web material 12 is unwound but also control the torque applied to the rotary dancer mechanism 10 in a closed loop fashion.

Referring to FIGS. 8-9, the box 200 represents the calculations that occur inside the controller 40. The controller 40 calculates a resultant output, $T_{app}$, which is the amount of torque applied to the rotary dancer mechanism 10 by the rotatable arm 22. The circle to the right of the box 200 represents the rotary dancer mechanism 10. Also shown are the forces which act on the rotary dancer mechanism 10.

In view of FIGS. 8-9, the position of the rotary dancer mechanism 10 is monitored by a position sensor 42 and continuously fed to the controller 40 along with web tension monitored by load cells 44, 46 prior to and after the rotary dancer mechanism 10. During operation, the controller 40 compares the web tension before the rotary dancer mechanism 10 and after the rotary dancer mechanism 10 to determine a web tension value. If the web tension value is out of a specified limit, the controller 40 may then calculate the amount of torque to apply to the rotary dancer mechanism 10. This signal is fed to the motor driving the rotatable arm 22 which adjusts the amount of torque applied to the rotary dancer mechanism 10. As described above, this may be a closed loop system such that these calculations may occur continuously as the web is processed.

The rotary dancer mechanism of the present disclosure may provide numerous benefits and advantages in relation to conventional linear dancer devices that move up and down. For instance, as shown by the equations above, the product of the mass of a rotary dancer mechanism and gravity are no longer forces that need to be accounted for in adjusting web tension. Consequently, the rotary dancer mechanism is extremely responsive to web tension variations and has a very fast reaction time Through the use of the rotary dancer mechanism the operating window of the dancer assembly is improved. Ultimately, the processing system has the ability to process more significantly OOR rolls while still feeding the unwound web into the processing line under constant tension. As explained above, because less OOR rolls may be processed, a manufacturer may not have to dry a web to the same extent as was required in the past. For instance, a web may be dried to greater than 2 percent moisture by weight, such as from about 2 percent to about 4 percent moisture by weight. Further, the rotary dancer mechanism of the present disclosure may allow for stacking of the OOR rolls leading to increased warehouse space and the ability to stockpile greater amounts of material.

Embodiments: In a first embodiment of the invention, the invention provides for a method for controlling tension in a web being unwound from an out-of-round roll of spirally wound web material having a major lobe and a minor lobe, the method comprising the steps of:

a. determining the major and minor lobe lengths of the out-of-round roll;
b. determining effective diameter of the out-of-round roll;
c. determining distance between the out-of-round roll and a rotary dancer mechanism comprising a non-driven roller disposed on a rotatable arm having a longitudinal axis, the rotatable arm attached to a motor configured to apply a controlled amount of torque to the arm and rotate the arm 360°;
d. unwinding web material from the out-of-round roll;
e. feeding unwound web material over the non-driven roller disposed on the rotatable arm;
f. rotating the arm 360°;
g. repeating steps a)-d) to determine an offset reference value; and
h. moving the non-driven roller along the longitudinal axis of the rotatable arm based on the determined offset reference value.

The method according to the preceding embodiment, wherein the major and minor lobes of the out-of-round roll are measured by a laser sensor.

The method according to the preceding embodiments, wherein the rotary dancer mechanism rotates twice as fast as the out-of-round roll.

The method according to the preceding embodiments, further comprising the step of monitoring the position of the rotatable arm and based upon the monitored positions, adjusting the torque applied by the motor to the arm.

The method according to the preceding embodiments, wherein the rotary dancer mechanism further comprises a counterweight disposed on the rotatable arm and movable along the longitudinal axis.

The method according to the preceding embodiments, wherein a position sensor determines angular position of the major and minor lobes of the out-of-round roll.

The method according to the preceding embodiments, further comprising the step of computing an amount of torque to be applied by the motor to the arm using an equation as follows:

$$\Theta^*=\phi^*\cdot 2+(\psi^*-F_{Phase})\cdot K_{phase}$$

wherein $\phi^*$ is an angular position of the unwind OOR roll;

$\Theta^*$ is an angular position of the rotary dancer mechanism;

$\psi^*$ is an angular offset (phase) of the major lobe of the roll in the unwind OOR roll;

$F_{Phase}$ is an angular offset (phase) of the tension peak relative to an unwind OOR roll angular position;

$K_{phase}$ is a phase controller. $K_{phase}$ may take the form of a proportional plus integral (PI) controller.

The method according to the preceding embodiments, further comprising the step of computing an amount of torque to be applied by the motor to the arm using an equation as follows:

$$X^*=OOR^*+(F_{mag}^*-F_{mag})\cdot K_{mag}$$

wherein

X* is a reference for the offset magnitude;

OOR* is an out of roundness measurement of parent roll expressed in linear units;

$F_{mag}^*$ is a reference for the magnitude of tension measurement ripple (non-DC component), often zero;

$F_{mag}$ is a measurement of the magnitude of tension measurement ripple (non-DC component);

$K_{mag}$ is a magnitude controller. $K_{mag}$ may take the form of a proportional plus integral (PI) controller.

The method according to the preceding embodiments, further comprising the steps of measuring tension wherein a controller receives the measured tension before the rotary dancer mechanism, receives the measured tension after the rotary dancer mechanism and based on such information, controls the amount of torque supplied to the rotary dancer mechanism.

The method according to the preceding embodiments, wherein the controller uses a closed loop algorithm for determining the amount of torque applied by the motor to the arm.

In a second embodiment of the invention, the invention provides for a method for controlling tension in a web being fed to a process comprising:

a. unwinding a roll of spirally wound web material;

b. feeding the unwound web material over a non-driven roller disposed on a rotatable arm having a longitudinal axis, the rotatable arm attached to a motor configured to apply a controlled amount of torque to the arm;

c. rotating the arm 360°;

d. sensing the tension of the web after it exits the non-driven roller; and e. controlling tension of the web material exiting the non-driven roller by adjusting the position of the non-driven roller along the longitudinal axis of the arm, by adjusting the amount of torque applied to the arm by the motor, or a combination of both.

The method according to the second embodiments, wherein the non-driven roller is disposed opposite of a counterweight and movable along the longitudinal axis.

The method according to the second embodiments, wherein the rotary dancer mechanism rotates twice as fast as the out-of-round roll.

The method according to the second embodiments, further comprising the step of monitoring the position of the rotatable arm and based upon the monitored positions, adjusting the torque applied by the motor to the arm.

The method according to the second embodiments, further comprising the step of computing an amount of torque to be applied by the motor to the arm using an equation as follows:

$$\Theta^*=\phi^*\cdot 2+(\psi^*-F_{Phase})\cdot K_{phase}$$

wherein $\phi^*$ is an angular position of the unwind OOR roll;

$\Theta^*$ is an angular position of the rotary dancer mechanism;

$\psi^*$ is an angular offset (phase) of the major lobe of the roll in the unwind OOR roll;

$F_{Phase}$ is an angular offset (phase) of the tension peak relative to an unwind OOR roll angular position;

$K_{phase}$ is a phase controller. $K_{phase}$ may take the form of a proportional plus integral (PI) controller.

The method according to the second embodiments, further comprising the step of computing an amount of torque to be applied by the motor to the arm using an equation as follows:

$$X^*=OOR^*+(F_{mag}^*-F_{mag})\cdot K_{mag}$$

wherein

X* is a reference for the offset magnitude;

OOR* is an out of roundness measurement of parent roll expressed in linear units;

$F_{mag}^*$ is a reference for the magnitude of tension measurement ripple (non-DC component), often zero;

$F_{mag}$ is a measurement of the magnitude of tension measurement ripple (non-DC component);

$K_{mag}$ is a magnitude controller. $K_{mag}$ may take the form of a proportional plus integral (PI) controller.

In a third embodiment of the invention, the invention provides for an apparatus for unwinding a web comprising:

a. a roll of spirally wound web material;

b. a first motor for rotating the roll of spirally wound web material;

c. a rotary dancer mechanism for controlling the tension of web material unwound from the roll of spirally wound web material comprising a rotatable arm having a longitudinal axis and first and second ends, a non-driven roller disposed on rotatable arm and movable along the longitudinal axis, a counterweight disposed on the rotatable arm opposite of the non-driven roller and movable along the longitudinal axis; and a second motor attached to the rotatable arm and configured to supply a controllable amount of torque to the arm; and d. a load cell in communication with the second motor and configured to sense the tension of web material unwound from the roll upon exiting the rotary dancer mechanism.

The apparatus according to the third embodiments, wherein the rotatable arm is connected to the motor by a shaft and is rotatable about the shaft 360°.

The apparatus according to the third embodiments, wherein the second motor is operatively attached to the rotatable arm by a belt.

The apparatus according to the third embodiments, further comprising a load cell and a controller, wherein the controller is in communication with the second motor and the load cell and configured to sense the tension of web material unwound from the roll upon exiting the rotary dancer mechanism. The apparatus according to the previous embodiment, wherein the controller is configured to control the amount of torque applied to the arm.

The apparatus according to the previous embodiment, wherein the controller is configured to control the position of the non-driven roller along the longitudinal axis of the arm.

The apparatus according to the third embodiments, further comprising a position sensor configured to sense the position of the rotatable arm.

In a fourth embodiment of the invention, the invention provides for a web tensioning apparatus comprising:

a. a rotatable arm having a longitudinal axis and first and second ends;

b. a non-driven roller disposed on rotatable arm and movable along the longitudinal axis;

c. a counterweight disposed on the rotatable arm opposite of the non-driven roller and movable along the longitudinal axis;

d. a motor attached to the rotatable arm and configured to supply a controllable amount of torque to the arm.

The apparatus according to the fourth embodiments, wherein the rotatable arm continuously rotates in at a 360° motion.

The apparatus according to the fourth embodiments, wherein the motor is operatively attached to the rotatable arm by a belt.

The apparatus according to the fourth embodiments, further comprising a load cell and a controller, wherein the controller is in communication with the motor and the load cell and configured to sense the tension of web material unwound from the roll upon exiting the rotatable arm.

The apparatus according to the previous embodiment, wherein the controller is configured to control the amount of torque applied to the arm.

The apparatus according to the previous embodiment, wherein the controller is configured to control the position of the non-driven roller along the longitudinal axis of the arm.

The apparatus according to the fourth embodiments, further comprising a position sensor configured to sense the position of the rotatable arm.

What is claimed is:

1. An apparatus for unwinding a web comprising:

a. a roll of spirally wound web material;

b. a first motor for rotating the roll of spirally wound web material;

a rotary dancer mechanism for controlling the tension of web material unwound from the roll of spirally wound web material comprising a rotatable arm having a longitudinal axis and first and second ends, a non-driven roller disposed on rotatable arm and movable along the longitudinal axis, a counterweight disposed on the rotatable arm opposite of the non-driven roller and movable along the longitudinal axis; and a second motor attached to the rotatable arm by a shaft, wherein the arm is rotatable about the shaft 360° and the second motor is configured to supply a controllable amount of torque to the arm and d. a position sensor configured to sense the position of the rotatable arm.

2. The apparatus according to claim 1 further comprising a load cell and a controller, wherein the controller is in communication with the second motor and the load cell and configured to sense the tension of web material unwound from the roll upon exiting the rotary dancer mechanism.

3. The apparatus of claim 2, wherein the controller is configured to control the amount of torque applied to the arm.

4. The apparatus of claim 2, wherein the controller is configured to control the position of the non-driven roller along the longitudinal axis of the arm.

* * * * *